US006767026B2

(12) United States Patent
Gignoux et al.

(10) Patent No.: US 6,767,026 B2
(45) Date of Patent: Jul. 27, 2004

(54) AUTOMATIC SNOWBOARD BINDING

(75) Inventors: Pierre Gignoux, Coublevie (FR); Alain Plassiard, Saint Egreve (FR)

(73) Assignee: Emery S.A., Saint Egreve (FR)

( * ) Notice: Subject to any disclaimer, the term of this patent is extended or adjusted under 35 U.S.C. 154(b) by 0 days.

(21) Appl. No.: 09/850,483

(22) Filed: May 7, 2001

(65) Prior Publication Data

US 2002/0000708 A1 Jan. 3, 2002

(30) Foreign Application Priority Data

May 10, 2000 (FR) ..... 00 05911

(51) Int. Cl.[7] ..... A63C 9/10
(52) U.S. Cl. ..... 280/624; 280/618
(58) Field of Search ..... 280/624, 623, 280/617, 618, 14.21, 14.22, 634

(56) References Cited

U.S. PATENT DOCUMENTS 5,299,823 A * 4/1994 Glaser ..... 280/14.21 X
5,520,406 A 5/1996 Anderson et al.
5,690,351 A * 11/1997 Karol ..... 280/618
5,871,226 A 2/1999 Klubitschko et al.
5,954,358 A 9/1999 Bejean et al.
6,099,018 A * 8/2000 Maravetz et al. ..... 280/624
6,105,996 A 8/2000 France
2003/0090088 A1 * 5/2003 Gignoux et al.

FOREIGN PATENT DOCUMENTS

| | | |
|---|---|---|
| EP | 0 778 055 B1 | 9/1996 |
| FR | 2 736 274 | 1/1997 |
| FR | 2 758 994 | 1/1997 |
| FR | 2 745 192 | 8/1997 |
| FR | 2 758 091 | 7/1998 |
| FR | 99 14696 | 11/1999 |
| WO | WO 96/05894 | 2/1996 |
| WO | WO 97/22390 A | 6/1997 |

OTHER PUBLICATIONS

French Preliminary Search Report in SN FR 0005911.

* cited by examiner

*Primary Examiner*—Bryan Fischmann
(74) *Attorney, Agent, or Firm*—Bugnion S.A.; John Moetteli

(57) ABSTRACT

Automatic snowboard binding holding the boot via its sides and having an automatic locking mechanism (11, 14), retention mechanism (6), and a boot-release lever (16) whose operation results in unlocking of the retention mechanism. The boot-release lever is kinematically independent of the locking mechanism (11, 14) in such a manner that it remains stationary when the boot is clipped into the binding.

3 Claims, 4 Drawing Sheets

AUTOMATIC SNOWBOARD BINDING

FIELD OF THE INVENTION

The invention relates to an automatic snowboard binding comprising a base carrying at least one retention means for holding a boot via at least one of its sides, shaped so as to engage with the retention means, comprising automatic means for locking the retention means, and a boot-release lever whose operation unlocks the retention means, this boot-release lever being articulated about a pin transverse to the base.

BACKGROUND OF THE INVENTION

Such a binding is known from patent application U.S. Pat. No. 6,105,996, the content of which is incorporated by reference. In this binding, the boot is equipped with two lateral studs which engage in guides into which they are inserted by elastically separating rotatably mounted cams which then lock the studs in the guides. The boot is released by means of a boot-release lever whose operation separates the cams so as to release the boot studs. The boot-release lever is linked kinematically to the cams in such a manner that it is moved by the cams when the boot is clipped (i.e., inserted) into the binding. Thus, on every such occasion, the boot-release lever is unexpectedly raised. This untimely activation of the boot-release lever gives rise to unnecessary wear of the latter and may constitute a source of irritation to the user.

Automatic snowboard bindings are, furthermore, known from patents FR 2 758 994, 2 736 274, 2 758 091, EP 0 778 055, U.S. Pat. No. 5,871,226, U.S. Pat. No. 5,954,358, the content of the US patents being incorporated by reference and also patent application U.S. Pat. No. 5,520,406, the content of which is incorporated by reference in all these constructions the boot-release lever is caused to move when the boot is clipped into the binding.

Patent FR 2 745 192 furthermore discloses a binding whose locking means comprise a rotary disk equipped with a locking notch and with a ratchet serration interacting with a catch which acts simultaneously as a boot-release lever. The boot-release lever is thus not only caused to move when the boot is clipped into the binding, but gives rise to noise when the boot is clipped into the binding by jumping over the teeth of the serration.

In U.S. Pat. No. 6,523,852, in the name of the applicant; automatic snowboard bindings are furthermore described which comprise two opposing cam jaws which are equipped with a movement arm intended to be moved by the boot, the cam-shaped part interacting with a blocking element which is movable in a guide in such a manner that a blocking of the jaw is ensured for various positions of the jaw. In these bindings, also, the boot-release lever is moved when the boot is clipped into the binding.

SUMMARY OF THE INVENTION

An aim of the present invention is to prevent movement of the boot-release lever when the boot is clipped into the binding.

To this end, the binding according to the invention is defined in that the boot-release lever is kinematically independent of the locking means in such a manner that it remains stationary when the boot is clipped into the binding, for example in a position in which it is lowered along the side of the base.

According to a preferred embodiment of the invention, the retention device is a jaw pivoting about a horizontal axis and integral with an movement arm intended to be moved by the boot during insertion of the boot into the binding this jaw having a part in the form of a cam interacting with a blocking element which is movable in a guide and urged by an elastic means in the blocking direction, the boot-release lever having a part shaped and positioned so as to move the blocking element unidirectionally in the direction of unlocking during raising of the boot-release lever.

The binding preferably comprises two symmetrical, opposed retention devices intended for holding the boot via its two sides, and the blocking elements are connected kinematically together by a bar. The boot-release lever has a lateral arm or tab engaged under said bar for the movement of this bar in the unlocking direction during raising of the boot-release lever.

BRIEF DESCRIPTION OF THE DRAWINGS

The appended drawing represents, by way of example, an embodiment of the binding according to the invention.

DETAILED DESCRIPTION OF THE PREFERRED EMBODIMENT

The binding comprises a base 1 of general rectangular shape intended to be fixed on a snowboard. This base 1 carries two identical, opposite binding elements 2 and 3 intended to hold a boot via its two sides, as described in patent application FR 99 14696. As the binding elements are identical, the element 2 only will be described.

Figure 2:
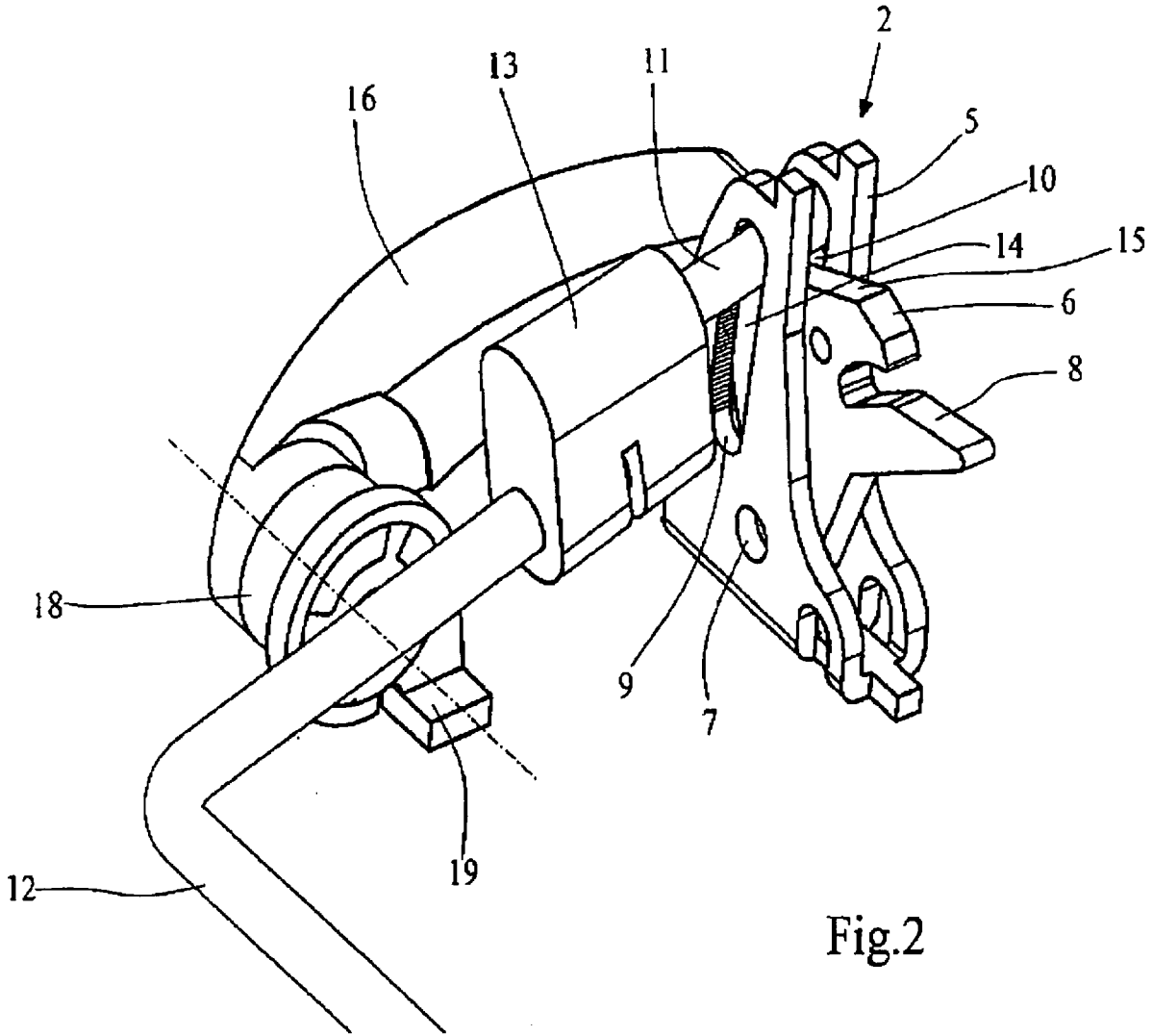
FIG. 2 is a detail view showing one of the jaws of the binding in the open position when the boot is out of the binding.

The binding element 2 comprises a frame 4 in which a stirrup, oriented vertically, is mounted, in which stirrup a jaw 6 is mounted, capable of pivoting about a pin 7 transverse to the stirrup against the action of a spring tending to hold the jaw in the open position, as shown in FIG. 2. The jaw is equipped with a pedal 8 for its movement by the boot when the boot is clipped into the binding. The stirrup 5 has two apertures 9 and 10 located facing one another and oriented substantially vertically. These apertures 9 and 10 serve for guiding a blocking finger or wedge 11 urged elastically downward by a bar 12 mechanically and kinematically connecting this blocking finger 11 to the blocking finger of the binding element 3, passing through the base 1. Such a binding is described in U.S. Pat. No. 6,523,852. More precisely, the outer side of the guide apertures 9 and 10 is slightly rounded, and the blocking fingers, such as the finger 11, are connected to the bar 12 by means of a linking piece 13 in such a manner as to constitute a kind of crank, it being possible for the piece 13 to turn freely on the U-shaped bar 12.

A torsional spring 20 biases the bar 12 downwardly. An end of the spring 20 is fixed in a vertical hole 26 (shown in phantom lines in FIG. 3) in the base 1. The other end of the spring 20 reacts against the portion of the bar 12 which enters into the linking member 13. The mid-portion of the spring 20 wraps around the bar 12. Note that a linking member cover portion 22 and a bar cover portion 24 of the base 1 cover and obscure each linking member 13 and the bar 12 so that its operation docs not interfere with the boot of the operator.

The jaw 6 has a part 14 in the form of a cam engaged in the stirrup 5, between the guide apertures 9 and 10. The upper part of the jaw 6 has a planar face 15 on which the blocking finger 11 bears when the boot is out of the binding. The binding is furthermore equipped with a boot-release lever 16 mounted pivotably on the frame 4 about a pin 17 parallel with and transverse to the base 1. More precisely, as shown in FIG. 2, the boot-release lever 16 is equipped with a hub 18 in the form of a drum containing a return spring which tends to hold the lever 16 in the lowered position. The hub 18 is equipped with an arm or tab 19 which extends transversely to the lever 16, parallel to the pin 17 and engaged under the bar 12.

Figure 3:
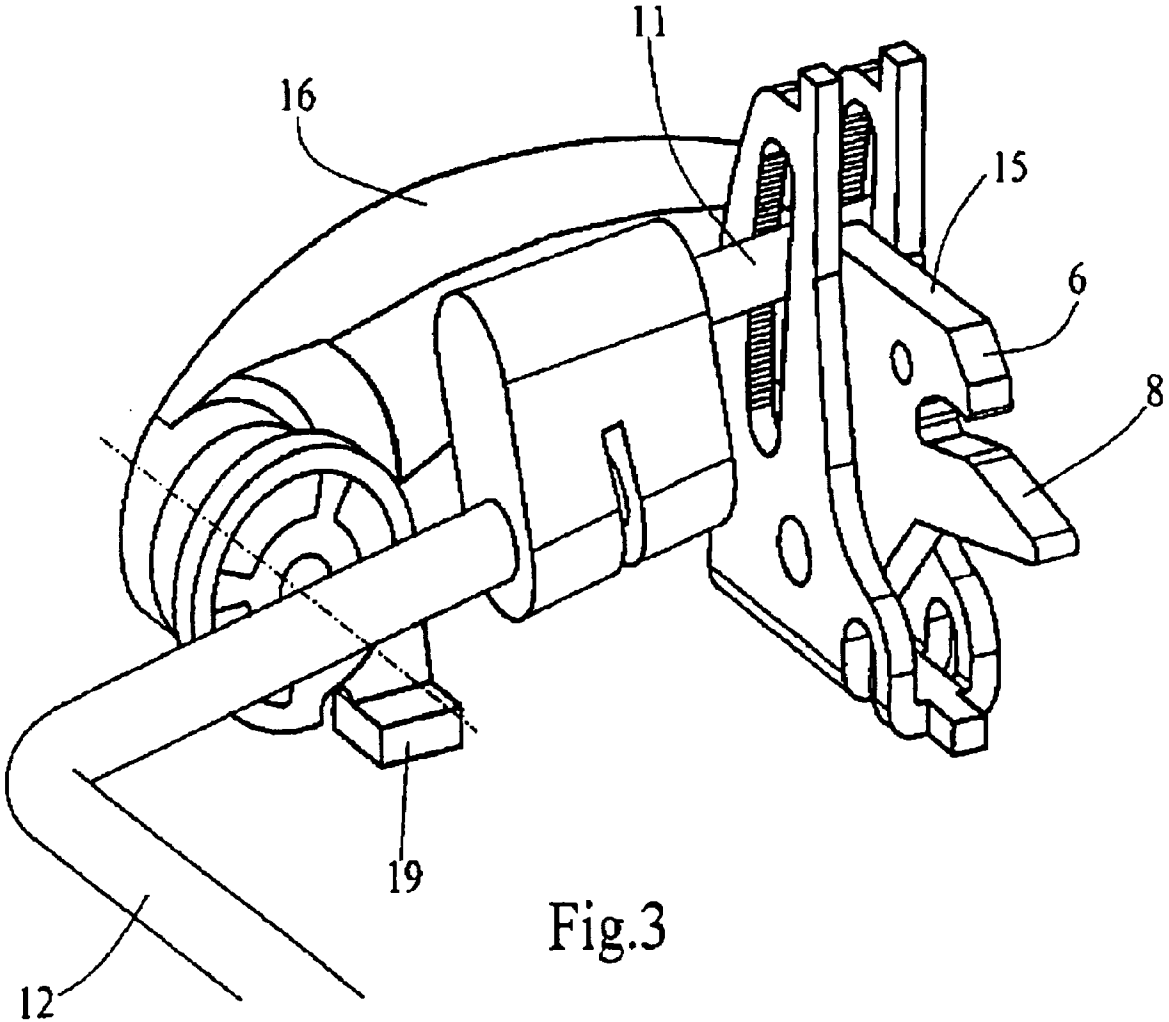
FIG. 3 shows the jaw of FIG. 2 in the position in which the boot is clipped into the binding.
Figure 4:
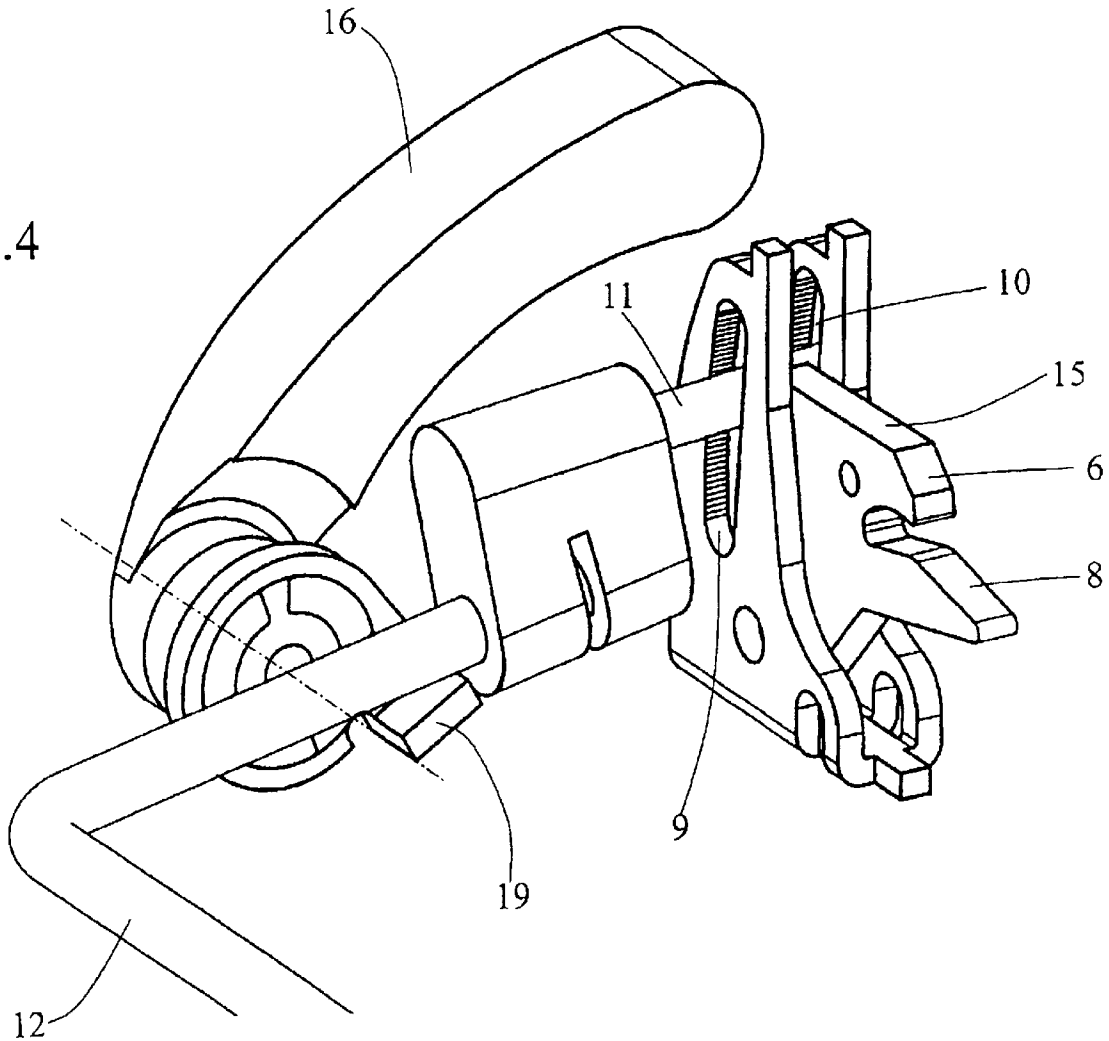
FIG. 4 shows the action of the boot-release lever at the start of the unlocking action.

FIG. 3 shows the binding element in the position in which the boot is clipped into the binding. The pedal 8 has been moved downward by the boot and the jaw 6 is engaged in a lateral housing of the boot. The blocking finger 11 has left the planar face 15 and has descended in the guide apertures 9 and 10 in order to block the cam part 14 of the jaw.

Figure 1:
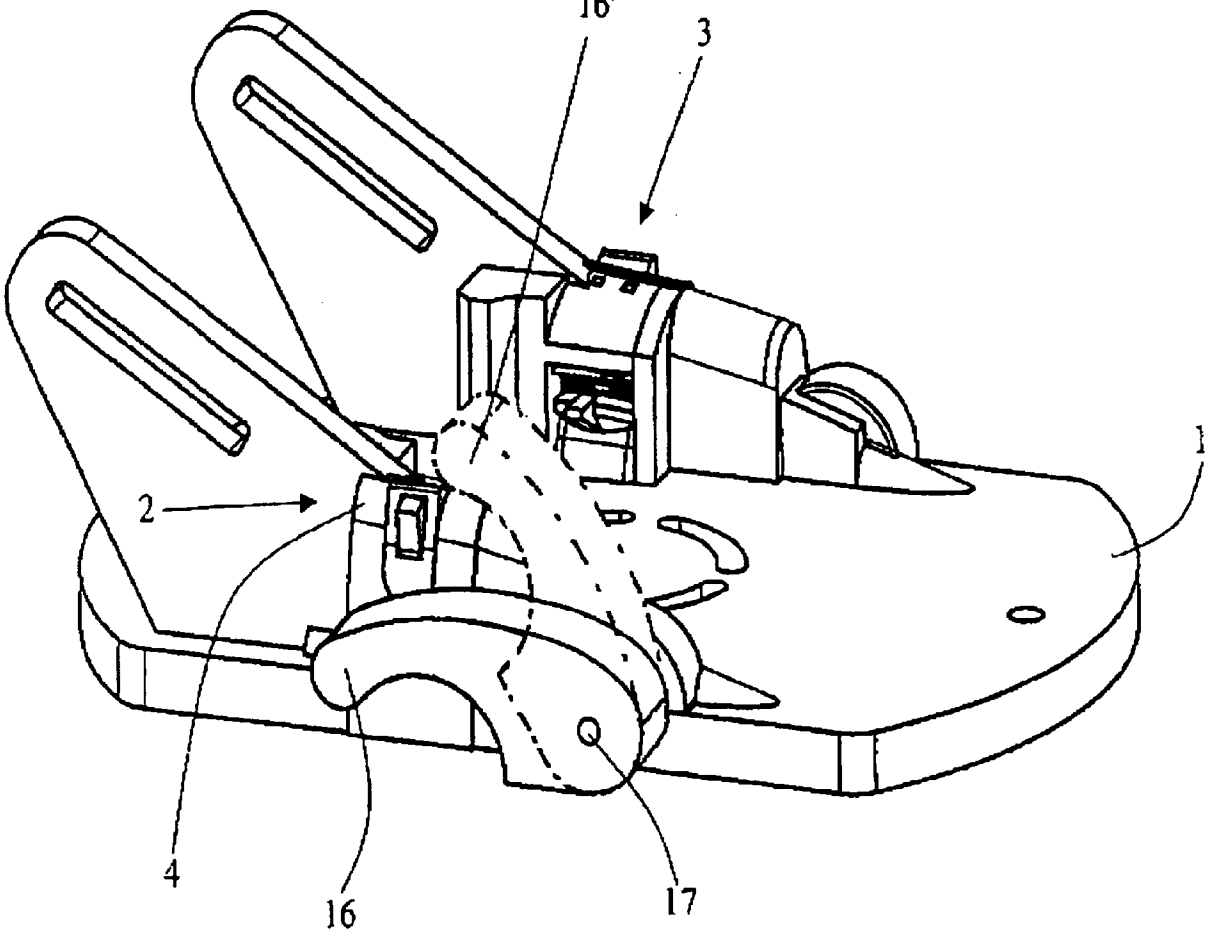
FIG. 1 shows a side, break-away view in perspective, with no boot in the binding.

In order to remove the boot from the binding, the boot-release lever 16 is raised into the position 16' shown in dot-dash lines in FIG. 1. During this raising movement, the arm 19 of the boot-release lever raises the bar 12 which moves the blocking finger 11 upward. When this finger 11 arrives at the top of the apertures 9 and 10, the jaw 6 is able to rise in order to return to the position shown in FIG. 2. The lever 16, now released, returns to the lowered position shown in solid lines in FIG. 1.

What is claimed:

1. An automatic snowboard binding for a boot having a longitudinal axis, the binding comprising:

(a) a base having a longitudinal axis substantially coinciding with the longitudinal axis of the boot;

(b) at least one retention device suitable for holding a boot via at least one of its sides, the at least one retention device located on either side of the longitudinal axis of the boot, the retention device being capable of being toward a locking position when the boot is inserted into the binding;

(c) locking mechanism, activated by such insertion of the boot into the binding, the locking mechanism locking the boot in the binding; and (d) a boot-release lever whose operation results in unlocking of the binding through movement of the retention device out of the locking position, this boot-release lever being articulated about a pin having a pivot axis transverse to the longitudinal axis of the base, wherein the boot-release lever is kinematically independent of the locking mechanism such that the lever remains stationary when the boot is inserted into the binding.

2. The binding as claimed in claim 1, wherein the retention device comprises a jaw pivotably mounted about a horizontal axis and integral with a movement arm which is movable by the boot during insertion of the boot into the binding, the jaw having a cam portion interacting with a wedge which is movable in a guide and capable of being elastically biased in a wedging direction, wherein the boot-release lever has a tab which is shaped and positioned so as to move the wedge unidirectionally toward an unlocked position, in a direction opposite the wedging direction, when the boot-release lever is raised.

3. The binding as claimed in claim 2, comprising two symmetrical, opposed retention devices intended tow holding the boat vat its two sides, in which a pair of wedges are connected kinematically together by a transverse bar, wherein the boot-release lever has a lateral tab engageable with the bar for the movement of the bar in an unlocking direction when the boot-release lever is raised.

* * * * *